United States Patent [19]

Matthews

[11] 4,197,082

[45] Apr. 8, 1980

[54] FUEL IGNITION CONTROL ARRANGEMENT EMPLOYING DUAL FLAME SENSORS

[75] Inventor: Russell B. Matthews, Goshen, Ind.

[73] Assignee: Johnson Controls, Inc., Milwaukee, Wis.

[21] Appl. No.: 896,699

[22] Filed: Apr. 17, 1978

[51] Int. Cl.[2] ..... F23Q 9/14

[52] U.S. Cl. ..... 431/25; 431/46; 431/71

[58] Field of Search ..... 431/24, 25, 46, 71, 431/74, 78

[56] References Cited

U.S. PATENT DOCUMENTS

| | | | |
|---|---|---|---|
| 2,616,490 | 11/1952 | Wilson et al. | 431/25 |
| 2,748,846 | 6/1956 | Smith et al. | 431/25 |
| 3,758,260 | 9/1973 | Newport | 431/78 |
| 3,840,322 | 10/1974 | Cade | 431/78 |
| 3,914,092 | 10/1975 | Matthews | 431/66 |
| 3,975,135 | 8/1976 | Kinsella | 431/43 |
| 3,975,136 | 8/1976 | Baysinger | 431/74 |
| 4,015,928 | 4/1977 | Carlson | 431/74 |
| 4,019,854 | 4/1977 | Carlson et al. | 431/78 |
| 4,035,134 | 7/1977 | Matthews | 431/21 |

*Primary Examiner*—Carroll B. Dority, Jr.

*Attorney, Agent, or Firm*—Emrich, Root, O'Keeffe & Lee

[57] ABSTRACT

A control arrangement for a pilot ignition type fuel ignition system includes a first switch device which effects energization of a pilot valve at the start of an operating cycle to supply fuel to a pilot outlet for ignition to provide a pilot flame. The first switch device is enabled by a control circuit which in turn is enabled over a path provided by a second switch device. The second switch device is enabled by a flame sensing circuit when a pilot flame is established and operates to effect energization of a main valve and to interrupt the enabling path for the control circuit, and a further flame sensing circuit maintains the first switch device, and thus the pilot valve, operated following operation of the second switch device.

17 Claims, 2 Drawing Figures

FUEL IGNITION CONTROL ARRANGEMENT EMPLOYING DUAL FLAME SENSORS

BACKGROUND OF THE INVENTION

1. Field of the Invention

This invention relates to fuel ignition systems, and more particularly to a control arrangement for use in such systems for controlling the operation of fuel valves of the system.

2. Description of the Prior Art

Various safety arrangements have been proposed for use in fuel ignition systems to prevent inadvertent energization of fuel valves of the system under fault conditions, such as a component failure in an electronic flame sensing circuit, or a welded contact failure of a flame relay. One such control arrangement for a pilot ignition type control system is disclosed in my U.S. Patent application Ser. No. 698,162, now U.S. Pat. No. 4,077,762. In this system, a pilot valve is energized over a path including normally closed contacts of a flame relay in response to closing of thermostatically controlled contacts. When a pilot flame is established, the flame relay is operated under the control of a flame sensing circuit to energize a main valve. A control relay, which is also energized over the path, including the normally closed contacts of the flame relay, provides a holding path for the pilot valve when the flame relay operates. In another control arrangement which is disclosed in my U.S. Pat. No. 4,035,134, a pilot valve is energized via contacts of a control relay which in turn is energized over a path including normally closed contacts of a flame relay.

A common feature of these arrangements is that the control relay is energized over a path which includes normally closed contacts of the flame relay. Thus, the control relay can be energized only when the flame relay is deenergized, and once energized, contacts of the control relay provide a holding path which permits the control relay to be maintained energized until the end of the heating cycle. If for any reason the flame relay is operated in the absence of a flame, or the normally closed contacts are open at the start of an ignition cycle, the energizing path for the control relay is interrupted so that the pilot valve cannot operate on the next call for heat. Also, through the use of a redundant pilot and main valve arrangement, 100% shut off of fuel is effected when the pilot valve is maintained deenergized.

SUMMARY OF THE INVENTION

The present invention has provided a control arrangement for use in a fuel ignition system for controlling the operation of valve means of the system. The control arrangement includes control means responsive to an activate means to provide a control signal, first switching means enabled by the control signal to prepare an energizing path for a fuel supply valve of the valve means, and second switching means operable to complete the energizing path for the valve to effect energization of the valve whereby fuel is supplied to a burner apparatus for ignition to provide a flame. The second switching means, when operated, also prevents the control means from providing its control signal. A first flame sensing means maintains the second switching means operated when a flame is provided at the burner apparatus, and a second flame sensing means, operable when a flame is provided, provides a further control signal for maintaining the first switching means operated after the control means is prevented from providing its control signal.

Thus, the control arrangement includes first and second flame sensing means one of which controls the operation of a first switching means which prepares an energizing path for the fuel supply valve, and the other of which controls the operation of a second switching means which completes the energizing path.

More specifically, in accordance with a disclosed embodiment, the control arrangement is employed in a pilot ignition type fuel ignition system which includes a pilot valve and a main valve. The pilot valve is interposed between an inlet of the main valve and a source of fuel so as to provide a redundant valve arrangement wherein fuel supply to both pilot and main burners is interrupted whenever the pilot valve is deenergized.

The first switching means is operable to effect energization of the pilot valve and to prepare an energizing path for the main valve which is completed by the second switching means when it operates. The control means which enables the first switching means is in turn enabled over a path provided by the second switching means when it is disabled. If for any reason the enabling path for the control means is interrupted at the start of an operating cycle, the first switching means is maintained disabled, preventing operation of both pilot and main valves.

The pilot valve is energized, supplying fuel to the pilot outlet during a trial for ignition interval defined by a timer device of the control means which effects deenergization of the pilot valve if a flame is not provided within such interval. Under normal operating conditions, the pilot flame becomes established before the end of the trial for ignition interval, and the first flame sensing means enables the second switching means which then effects energization of the main valve to supply fuel to the main burner. The second switching means also causes the control means to be disabled at such time, and the first switching means is then maintained enabled by the second flame sensing means.

The control arrangement provides 100% shut off of fuel to both pilot and main burners under unsafe conditions, including a component failure in either one of the flame sensing means. For example, the first switching means is prevented from operating in the event of a fault condition for the first flame sensing means which permits the second switching means to operate in the absence of a flame. For such condition, the control means is prevented from responding to the activate means to provide its control signal so that the first switching means is maintained disabled, preventing operation of the pilot and main valves. For a fault condition of the second flame sensing means which permits the first switching means to be enabled in the absence of the flame, the timer device of the control means interrupts the energizing path for the pilot valve thereby interrupting fuel supply to both pilot and main burners.

To assure lock out under the failure conditions referred to above, the first and second flame sensing means are energized continuously and independently of the activate means which enables the control means at the start of an operating cycle. Accordingly, a fault of either flame sensing means which permits its associated switching means to be operated in the absence of a flame, will result in lock out of the system with 100% shut off of fuel.

In accordance with a feature of the invention, the control means includes delay means which delays the occurrence of its control signal, and thus the enabling of the first switching means, for a predetermined time after the control means is enabled. Accordingly, if, following a successful start-up, there is a failure in the flame sensing means associated with the second switching means and a momentary loss of power occurs, then the delay afforded by the delay means assures that the second switching means operates before the first switching means when power is restored, thereby manifesting the fault.

DESCRIPTION OF A PREFERRED EMBODIMENT

Figure 1:
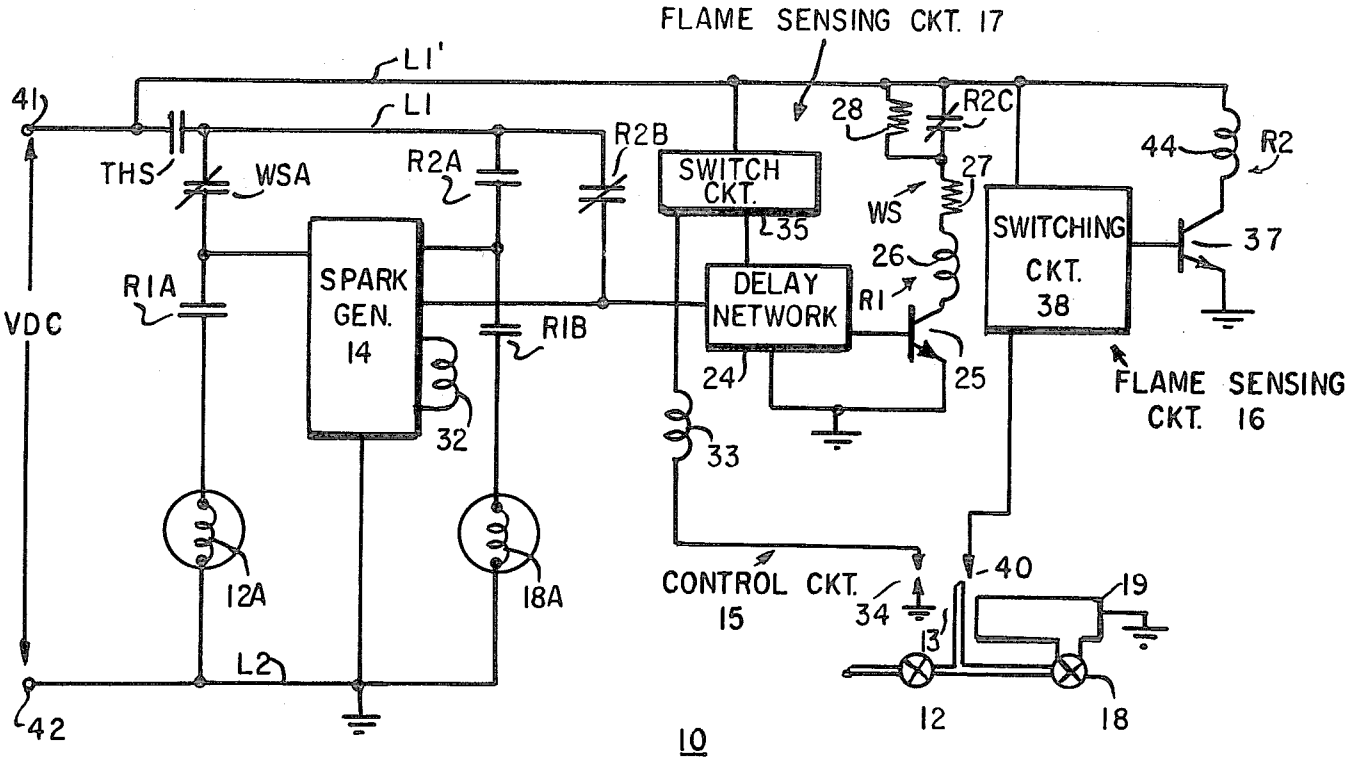
FIG. 1 is a block diagram of a control arrangement for a fuel ignition system provided by the present invention; and, FIG. 2 is a schematic circuit diagram for the control arrangement shown in FIG. 1.

Referring to FIG. 1, there is shown a block diagram for a control arrangement 10 provided by the present invention. By way of illustration, the control arrangement 10 is described with reference to an application in a heating system of the proven pilot type wherein the fuel supply control includes a pilot valve 12 operable to supply fuel to a pilot outlet 13 of a burner apparatus for ignition by sparks provided by a spark generator 14 to establish a pilot flame, and a main valve 18 for supplying fuel to a main burner 19 of the burner apparatus 19 for ignition by the pilot flame.

As shown in FIG. 1, the pilot valve is connected in series with the main valve 18, providing a redundant valve arrangement wherein main burner fuel passes through both the pilot valve 12 and the main valve 18. Accordingly, whenever the pilot valve 12 is deenergized, the flow of fuel to the main valve 18, and thus to the main burner 19, is also shut off.

The operate solenoid 12A of the pilot valve 12 is energized via contacts R1A of a first switching device, embodied as a relay R1, which is enabled by a control circuit indicated generally at 15. The control circuit 15 in turn is enabled by an activating device, embodied as thermostatically controlled contacts THS which close in response to a request for heat. The control circuit 15 includes a timer device, embodied as a warp switch WS which is energized at the start of each heating cycle to define of trial for ignition period and to effect deenergization of the pilot valve via its contacts WSA if a pilot flame is not established before the end of such time.

When a pilot flame is provided, a flame sensing circuit 16 effects energization of the operate solenoid 18A of the main valve 18 by way of contacts R2A of a second switching device, embodied as a relay R2.

In accordance with the invention, the enabling of control circuit 15 is effected over a path including normally closed contacts R2B of the relay R2 which controls the operation of the main valve. The control circuit 15 can be enabled only when the relay R2 is not operated and its contacts R2B are closed. When the control circuit 15 is disabled following operation of relay R2, the relay R1 is maintained energized by a further flame sensing circuit 17.

Thus, the operation of relay R1 is controlled by flame sensing circuit 17, and the operation of relay R2 is controlled by a separate flame sensing circuit 16. Relay R1 provides an integrity check for the flame sensing circuit 16 in that the energization of relay R1 is prevented whenever relay R2 is operated or its contacts R2B are open. Under such condition, contacts R1A and R1B of the relay R1 are maintained open, preventing energization of the pilot valve solenoid 12A and the main valve solenoid 18A. Also, contacts R2A and R2B of relay R2 employ a common armature of relay R2 and have a common movable contact. Accordingly, if contacts R2A, which control the energization of the main valve solenoid, become welded together, contacts R2B cannot reclose when relay R2 is deenergized at the end of the heating cycle. For such condition, contacts R2B remain open and the system is locked out.

For any fault of the flame sensing circuit 17 or of the control circuit 15 which permits relay R1 to be energized in the absence of a flame, the warp switch will be energized, and after a delay defined by the heating time of its heater element 27, the warp switch will operate to open its contacts WSA to interrupt the energizing path for the pilot valve solenoid 12A. This prevents fuel from being supplied to both the pilot outlet 13 and the main burner 19.

Considering the control arrangement in more detail, power is supplied to the control arrangement via input terminals 41 and 42 which are connectable to a suitable DC power source (not shown) which, for example, may provide 12 volts DC to the control arrangement. The spark generator 14 and the control circuit 15 are energized by power supplied over conductors L1 and L2 when thermostatically controlled contacts THS are closed. Contacts THS are interposed between conductor L1 and terminal 41, and conductor L2, which serves as system ground is connected directly to terminal 42.

The flame sensing circuits 16 and 17 are connected between a conductor L1' and ground, or conductor L2, such that the flame sensing circuits 16 and 17 are energized continuously and independently of the contacts THS.

Referring to the control circuit 15, the control circuit 15 includes a delay network 24 which is enabled in response to the closing of contacts THS following a request for heat. The delay network 24 effects energization of the operate winding 26 of relay R1 and the heater element 27 of the warp switch WS by way of a switching device, embodied as a transistor 25. The enabling input of the delay network 24 is connected to conductor L1 over normally closed contacts R2B of relay R2, and thus the delay network can be enabled only when contacts R2B are closed.

The energizing path for the relay winding 26 and the warp switch heater element 27 further includes normally closed contacts R2C of relay R2. Contacts R2C, when closed, shunt a resistor 28, which provides a holding path for the winding 26 and heater element 27 when relay R2 operates. The resistor 28 decreases the current flow through the warp switch heater 27 to a level which prevents the warp switch from operating but which is high enough to maintain the relay R1 operated. However, relay R1 cannot energize through resistor 28.

As indicated above, relay R1 has normally open contacts R1A and R1B, respectively connected in series with the operating solenoids 12A and 18A of the pilot and main valves. The warp switch WS has normally closed contacts WSA connected in the energizing path for the pilot valve solenoid 12A.

The spark generator 14 is also energized over warp switch contacts WSA and contacts R2B of relay R2, the spark generator being maintained disabled until relay R1 operates to close it contacts R1B. As will be shown in more detail hereinafter, the spark generating circuit 14 basically comprises an oscillator circuit which, when enabled, provides periodic current pulses through a primary winding 32 of an ignition transformer. Such current pulses induce high pulses in a secondary winding 33 of the ignition transformer. The voltage pulses are applied to spark electrodes 34 which are positioned in the proximity of the pilot outlet 13, causing sparking at the electrodes for igniting pilot fuel. The spark generator 14 is disabled in response to the opening of contacts R2B with operation of relay R2 when a pilot flame is established.

Referring to the flame sensing circuit 17, this circuit basically comprises a switching circuit 35 which employs the spark electrodes 34 as its flame sensing probe. When a flame is established and bridges the gap between the electrodes 34, current flows from conductor L1' over the switching circuit, winding 33 of the ignition transformer and the flame to ground. This enables the switching circuit to provide a control output to the base of transistor 25 which maintains transistor 25 enabled. This in turn maintains relay R1 operated as long as a flame remains established.

The flame sensing circuit 16 controls the enabling of relay R2 by way of a switching device, embodied as a transistor 37. The flame sensing circuit 16 includes a switching circuit 38 having an associated sensing probe 40 located at the proximity of the pilot outlet 13. The switching circuit 38 is enabled in response to current flow from conductor L1' through the switching circuit 38 and via probe 40 and the flame to ground, enabling the transistor 37 which completes an energizing path for the operate winding 44 of the relay R2, permitting the relay R2 to operate. When relay R2 operates, it closes its contacts R2A to complete an energizing path for the main valve and to disable the spark generator 14. Contacts R2B also open, disabling the delay network 24, and contacts R2C open, inserting resistance 28 into the energizing path for the warp switch heater 27 and the operate winding 26 of relay R1.

OPERATION

When power is applied to the input terminals 41 and 42 of the system, the flame sensing circuits 16 and 17 are energized via conductors L1' and L2. As indicated above, the continuous energization of the flame sensing circuits 16 and 17, ahead of the thermostat contacts THS, permits either relay R1 or R2 to operate to manifest a fault condition for the associated flame sensing circuit.

When contacts THS close in response to a request for heat, power is extended to conductor L1 and over contacts R2B of relay R2 to the delay circuit 24 which after a predetermined time delay enables transistor 25 which completes an energizing path for relay winding 26 and warp switch heater 27. Relay R1 then operates closing its contacts R1A to energize the pilot valve solenoid 12A causing the pilot valve 12 to operate supplying fuel to the pilot outlet 13. The spark generator 14 is also enabled when contacts R1B close, and generates sparks at electrodes 34 for igniting the pilot fuel. If the pilot flame is not established within the heating time of the warp switch, typically twenty seconds, contacts WSA open, deenergizing the pilot valve.

When a pilot flame is established before the end of the trial for ignition time defined by the warp switch, and bridges the gap between the sensing probe 40 and the grounded burner 19, current flow through switching circuit 38 enables the circuit to cause transistor 37 to conduct completing an energizing path for the operate winding of relay R2. Relay R2 then operates, closing contacts R2A to complete the energizing path for the main valve solenoid, supplying fuel to the main burner 19, and opening contacts R2B to disable the spark generator 14. Relay R2 also opens contacts R2C connecting resistor 28 into the energizing path for relay winding 26 and warp switch heater 27. The lower current level over the holding path including resistor 28 maintains relay R1 operated, but prevents the warp switch WS from operating.

The flame also bridges the gap between the spark electrodes 34 providing current flow through switching circuit 17 which provides a signal for maintaining transistor 25 enabled.

When the heating demand has been met, contacts THS open, deenergizing the pilot and main valves to interrupt the supply of fuel to the pilot outlet 13 and the main burner 19. When the flame is extinguished, the flame sensing circuit 16 effects deenergization of relay R2, and flame sensing circuit 17 effects deenergization of relay R1.

The use of two separate flame sensing circuits for controlling the flame relay R2 and the control relay R1 affords protection against failure of either flame sensing circuit 16 or 17 resulting in inadvertant energization of the fuel valves. For example, for a failure of flame sensing circuit 16 or transistor 37, which permits relay R2 to be energized in the absence of a flame, contacts R2C are open thereby preventing operation of relay R1. For such condition, both fuel valves are maintained deenergized. A failure in the flame sensing circuit 17 or transistor 25 which permits relay R1 to operate also results in energization of the warp switch heater 27, allowing the warp switch to interrupt the energizing path for the pilot valve solenoid. Thus, the pilot valve is deenergized interrupting fuel supply to the pilot outlet and the main valve.

As indicated above, the control circuit 15 includes a delay network 24 which delays the occurrence of its control signal, and thus the enabling of the relay R1 for a predetermined time after the control means is eanbled. Accordingly, if, following a successful start-up, there is a failure in the flame sensing circuit 16 and a momentary loss of power occurs, then the delay afforded by the delay network 24 assures that the relay R2 can operate before relay R1 when power is restored, thereby manifesting the fault.

If a fault should occur after a successful start-up, followed by a flameout, or fuel interruption and then the flame sensing circuit 17 responds as though a flame were present, the flame sensing circuit 16 controlled by sensor probe 40 recognizes the no-flame condition and de-energizes relay R2. Accordingly, contacts R2A open to shut off the main valve, and contacts R2B reclose to energize the spark generator 14 to relite the pilot fuel.

If the pilot fuel relites, then when the flame contacts sensor probe 40, flame sensing circuit 16 reenergizes relay R2 which closes contacts R2A to turn on the main valve to complete the heating cycle.

At the end of the heating cycle, contacts THS open to shut off the fuel supply to the pilot and main burners, extinguishing the flame. However, because a failure is, in this illustrative example, assumed to be present in the flame sensing circuit 17, then current will flow through contacts R2C, warp switch heater 27, relay winding 26 and transistor 25. This causes the warp switch heater to heat sufficiently to open contacts WSA to lock out pilot valve. The circuit will not restart, thereby manifesting a failure condition.

Further, if a fault should occur after start-up in the flame sensing circuit 16 controlled by sensor probe 40, followed by a fuel outage, flame sensing circuit 17 via electrodes 34 will sense the loss of flame and cause relay R1 to drop out, shutting off both the pilot and the main valves within 0.8 seconds. The circuit cannot be restarted because contacts R2C will be maintained open.

DETAILED DESCRIPTION

Figure 2:
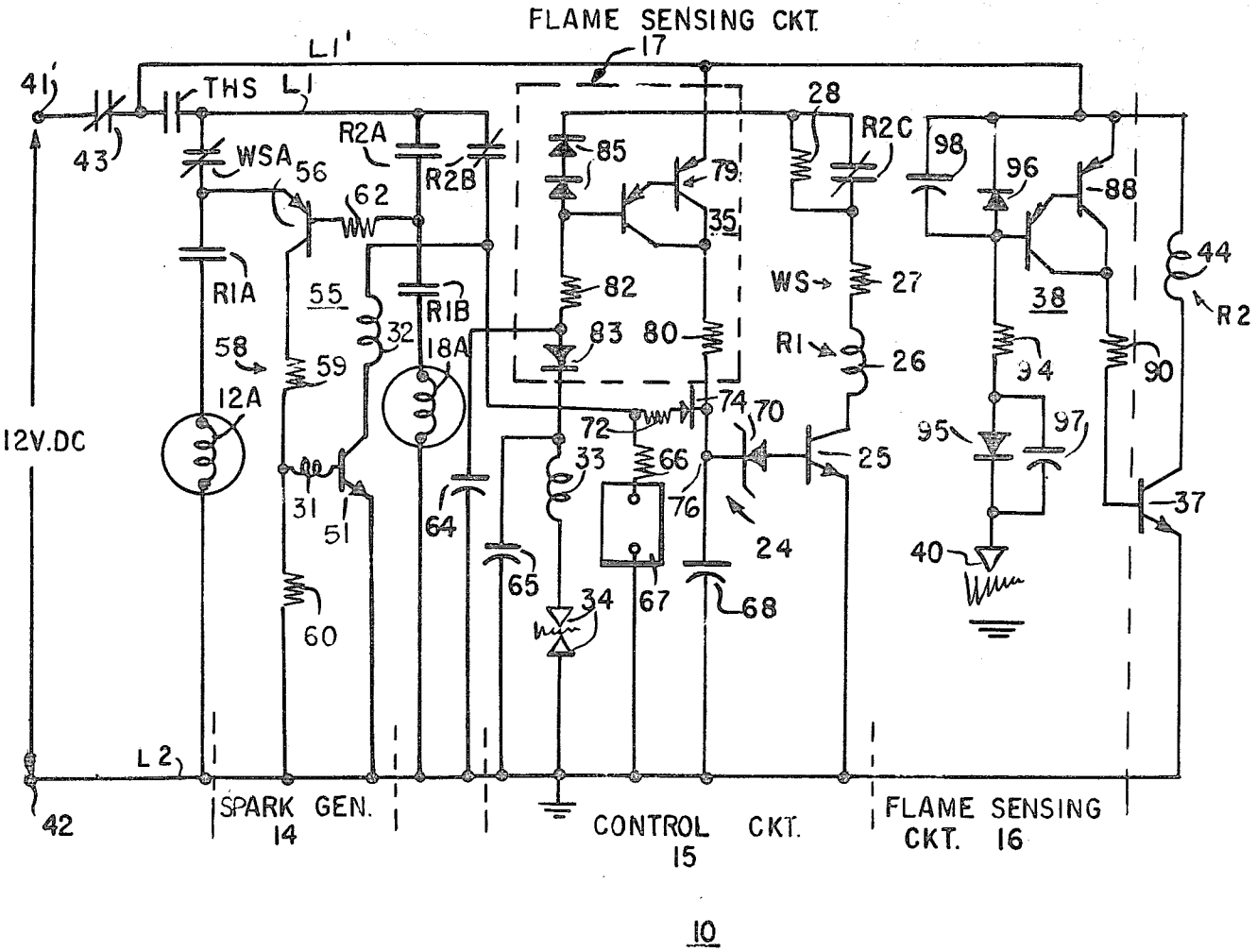

Referring to FIG. 2, there is shown a schematic circuit diagram for the fuel ignition control system 10 shown in block diagram form in FIG. 1. Input terminal 41 of the system 10 is shown connected over a power switch 43 to a terminal 41' which together with input terminal 42 are connectable to a 12 volt DC power source. The control arrangement 10 is energized whenever switch 43 is closed.

With reference to the spark generating circuit 14, the spark generating circuit is similar to one disclosed in my U.S. Pat. No. 3,914,092, and accordingly will not be described in detail. Briefly, the spark generator 14 includes a transistor 51 and a high voltage ignition transformer having high voltage primary winding 32, secondary winding 33, and a feedback winding 31. The spark generator 14 further includes an enabling circuit 55 including transistor 56 and a voltage dividing network 58 comprised of resistors 59 and 60. The enabling circuit 55 provides base current to the transistor 51 which receives collector current via winding 32 and contacts R2B from Line L1.

Referring to the enabling circuit 55, transistor 56 has its emitter connected over normally closed warp switch contacts WSA to conductor L1 and its base connected over a resistor 62, normally open contacts R1B of relay R1 and the main valve operate solenoid 18A to conductor L2. Resistors 59 and 60 are connected in series between the collector of transistor 56 and conductor L2. Thus, when contacts THS are closed, and relay R1 is operated, transistor 56 is enabled supplying base drive to transistor 51 via resistors 59 and 60 and feedback winding 31 which is connected in the base circuit of transistor 51.

The collector of transistor 51 is connected over primary winding 32 of the ignition transformer and normally closed contacts R2B to conductor L1, and the emitter of the transistor 51 is connected to conductor L2. Thus, when the enabling circuit 55 provides base current to transistor 51, and current is flowing through normally closed contacts R2B and winding 32 to the collector of transistor 51, a voltage is produced in the feedback winding 31 causing the circuit to oscillate in a conventional manner to produce high voltage pulses in the secondary winding 33. These voltage pulses are applied to the spark electrodes 34 providing sparks to ignite the pilot fuel. The capacitors 64 and 65 are bypass capacitors which bypass some of the high frequency components generated by the spark generator 14.

Referring to the control circuit 15, the delay network 24 includes a timing capacitor 68, and a threshold device, embodied as a 4.7 volt zener diode 70. The capacitor is connected in a series charging path between conductors L1 and L2 over normally closed contacts R2B, a resistor 72, a diode 74 and the capacitor 68. This permits capacitor 68 to be charged in response to closing of contacts THS whenever contacts R2B are also closed. Also, an indicator 67, shown connected in series with current limiting resistor 66 between contacts R2B and conductor L2, indicates when contacts THS are closed and the main valve is not operated.

As capacitor 68 charges, the control potential at point 76 at the junction of the cathode of the zener diode 70 and one side of the capacitor 68 increases, and when the potential reaches 4.7 volts the diode 70, which is connected between the base of transistors 25 and point 76, is enabled and base current is provided to transistor 25. Transistor 25 is thus enabled to energize the relay winding 26 and warp switch heater 27. Capacitor 68 discharges by leakage through Zener diode 70 and the base-emitter circuit of transistor 25.

Considering the flame sensing circuit 17, the switching circuit 35 includes Darlington connected transistors 79 having a collector connected over a resistor 80 to point 76, an emitter connected to conductor L1', and base connected over a resistor 82, a diode 83 and the winding 33 to one of the electrodes 34, the other of which is connected to ground. A pair of series connected diodes 85, which are connected from base-emitter of transistor 79, provide temperature compensation to provide a current path from the emitter to base of the transistor 79 that varies inversely with ambient temperature change.

When a flame is established at the pilot outlet 13, current flows from conductor L1' over the emitter to base of the Darlington transistor 79 and over resistor 82, diode 83, winding 33 and the flame to conductor L2, causing transistor 79 to conduct. This provides current flow over the emitter to collector circuit of the transistor and resistor 80 to the base of transistor 25. This control current maintains the transistor 25 enabled as long as a flame remains established.

Referring to flame sensing circuit 16, switching circuit 38 is generally similar to switching circuit 35 and includes Darlington connected transistors 88 having a collector connected over a resistor 90 to the base of transistor 37, an emitter connected to conductor L1', and a base connected over a resistor 94, and a diode 95 to sensor probe 40. A diode 96 provides temperature compensation and capacitors 97 and 98 by pass high frequency components produced by the spark generator 14.

When a flame impinges on probe 40, current flow from conductor L1', through the emitter-base circuit of transistor 88, resistor 94 diode 95 and the flame to ground, enables transistor 88. When enabled, transistor 88 provides base drive to transistor 37 which conducts, providing an energizing path for winding 44 of relay R2.

OPERATION

Assuming power is applied to input terminals 41' and 42 and that power switch 43 is closed and contacts THS are open, then the flame sensing circuits 16 and 17 are energized and the spark generator 14 and control circuit 15 are deenergized.

When contacts THS close extending power from terminal 41' to conductor L1, current flows from conductor L1 over contacts R2B, resistor 66 and indicator 67 to conductor L2, energizing the indicator. Current also flows from conductor L1 over contacts R2B, resistor 72, diode 74 and capacitor 68 to conductor L2, charging the capacitor 68. As the capacitor charges, the potential at point 76 increases and when such potential reaches 4.7 volts, the break down voltage for the zener diode 70, the diode breaks down supplying base current to transistor 25. The transistor 25 then conducts from collector to emitter, permitting current flow from conductor L1′ over contacts R2C, warp switch heater 27, relay winding 26 and the transistor 25 to conductor L2. Accordingly, relay R1 operates closing its contacts R1A to energize the pilot valve to supply fuel to the pilot outlet 13.

Contacts R1B also close, enabling current to flow from conductor L1 over contacts WSA and the emitter base circuit of transistor 56, resistor 62, contacts R1B and the main valve solenoid 18A to conductor L2. Accordingly, transistor 56 conducts from the emitter to collector, permitting current flow over resistors 59 and 60 supplying base drive to transistor 51 over winding 31. The base drive supplied to the transistor 51 enables the transistor to begin to conduct permitting current flow through primary winding 32 via contacts R2B. This produces a voltage and the feedback winding 31, and the circuit oscillates in a conventional manner to produce high voltage pulses in the secondary windings 33 which are applied to the spark electrodes 34 producing sparks for igniting the pilot fuel. Such operation continues until the pilot fuel is ignited or the warp switch WS operates to open its contacts WSA.

Assuming the pilot fuel is ignited before the end of the trial for ignition, defined by the warp switch, then the flame impinges on the spark electrodes 34 and the sensing probe 40. Accordingly, current flows from conductor L1′ over the emitter-base of transistor 79, resistor 82, diode 83, winding 33 and the flame to conductor L2, enabling transistor 79 to conduct emitter to collector to supply base drive to transistor 25 over resistor 80 and diode 70. Similarly, transistor 88 conducts supplying base drive to transistor 37 which then conducts collector to emitter, permitting current flow from conductor L1′ over winding 44 of relay R2 and transistor 37 to conductor L2 causing relay R2 to operate.

When relay R2 operates, contacts R2A close completing the energizing path for the main valve solenoid 18A which operates to supply fuel to the main burner for ignition by the pilot flame. Also, contacts R2B open deenergizing the indicator and interrupting the enabling path for the delay network 24, the transistor 25 being maintained enabled by the flame sensing circuit 17. Also, contacts R2C open, inserting current limiting resistor 28 into the energizing path for the warp switch heater 27 and relay winding 26.

When the heating demand has been met, contacts THS open deenergizing the fuel valves to cause the flame to be extinguished. When the flame is extinguished, the base current paths for transistors 79 and 88 are interrupted, and the transistors turn off, disabling transistors 25 and 37, deenergizing relay R1 to open contacts R1A and R1B, and deenergizing relay R2 to open contacts R2A and close contacts R2B and R2C, preparing the system for the next operating cycle.

The manner in which the control arrangement operates to prevent energization of the fuel valves under failure conditions of either flame sensing circuit has been described above with reference to FIG. 1 and accordingly, will not be repeated in detail. Regarding the detailed showing of the control arrangement provided in FIG. 2, it is apparant that for any failure of the spark generator 14, which prevents the generation sparks at the start of an operating cycle, the warp switch WS is effective to deenergize the pilot valve, providing 100% shut off of fuel supply, at the end of the trial for ignition interval. Also, if relay R1 is prevented from operating, as for example due to an open circuit condition for transistor 25, the relay winding 26, or the warp switch heater 27, then transistor 56 is maintained cutoff since contacts R1B remain open, and the spark generator is inhibited.

For a fault condition of flame sensing circuit 16, such as an emitter-collector short for transistor 88 or transistor 37, or if for any reason a low impedance path is provided between sensing electrode 40 and ground, then relay R2 is maintained operated, opening its contacts R2C preventing energization of relay R1. Similarly, for an emitter-collector short for transistor 79 or transistor 25, or if for any reason a low impedance path is provided between spark electrodes 34, then the warp switch heater 27 is maintained energized, and its contacts WSA will open to place the pilot valve in flow preventing position.

I claim:

1. In a fuel ignition system including valve means having at least one fuel supply valve operable when energized to supply fuel to a burner apparatus for ignition to provide a flame, a control arrangement comprising activate means, control means responsive to said activate means to provide a control signal, first switching means enabled by said control signal to prepare an energizing path for the fuel supply valve, second switching means operable to complete the energizing path for the valve to effect energization of the valve and to prevent said control means from providing its control signal, first flame sensing means for maintaining said second switching means operated when a flame is provided at said burner apparatus, and second flame sensing means operable when a flame is provided at said burner apparatus to provide a further control signal for maintaining said first switching means enabled after said control means is prevented from providing its control signal.

2. A system as set forth in claim 1 wherein said control means includes delay means for delaying the occurance of said control signal for a predetermined time interval after said control means is enabled, thereby delaying the enabling of said first switching means for said predetermined time interval.

3. A system as set forth in claim 1 wherein said activate means includes input means connectable to a source of power and normally open thermostatically controlled switch contacts operable to connect said control means to said input means, said first and second flame sensing means being connected directly to said input means permitting said first and second flame sensing means to be energized continuously and independently of said activate means.

4. A system as set forth in claim 1 wherein said valve means includes a pilot valve which is operable when energized to supply fuel to a pilot outlet of said burner apparatus for ignition to provide a pilot flame, and wherein said one fuel supply valve is operable when energized to supply fuel to a main burner of said burner apparatus for ignition by the pilot flame, said first switching means being operable when enabled to effect energization of said pilot valve and to prepare an energizing path for said main valve, and said first flame sensing means being operable to enable said second switching means when a flame becomes established at said burner apparatus to complete said energizing path for said main valve.

5. A system as set forth in claim 4 wherein said control means includes timing means energized whenever said first switching means is enabled, said timing means being operable to effect deenergization of said pilot valve at the end of a predetermined time interval after said timing means is energized, and said second switching means being operable when enabled to override said timing means to prevent said timing means from deenergizing said pilot valve.

6. A system as set forth in claim 4 wherein said first switching means comprises a first switch device and enabling means responsive to either one of said control signals to provide an energizing path for said first switch device, said first switch device being operable when energized to complete an energizing path for said pilot valve and to prepare an energizing path for said main valve.

7. A system as set forth in claim 6 wherein said second switching means comprises a second switch device and a second enabling means responsive to said first flame sensing means to provide an energizing path for said second switch device, said second switch device being operable when energized to complete said energizing path for said main valve and to interrupt an enabling path for said control means.

8. A system as set forth in claim 7 wherein said second switch device is further operable to interrupt said energizing path for said first switch device, said first switching means including means for providing a holding path for said first switch device.

9. In a fuel ignition system including a pilot valve operable when energized to supply fuel to a pilot outlet of a burner apparatus for ignition by sparks provided by a spark generator to provide a pilot flame, and a main valve operable when energized to supply fuel to a main burner of the burner apparatus for ignition by the pilot flame, a control arrangement comprising first switching means for controlling the operation of the pilot valve, second switching means for controlling the operation of said main valve, activate means, control means enabled by said activate means over a path provided by said second switching means to provide a control signal, said first switching means being enabled by said control signal to effect energization of said pilot valve, first flame sensing means operable when a flame is provided at said burner apparatus to enable said second switching means to effect energization of said main valve and to interrupt said enabling path for said control means to prevent said control means from providing its control signal, and second flame sensing means operable when a flame is provided at said burner apparatus to provide a further control signal for maintaining said first switching means enabled after said control means is prevented from providing its control signal.

10. A system as set forth in claim 9 wherein said control means includes delay means for delaying the occurrance of said control signal for a predetermined time after said control means is enabled, said delay means including means responsive to said activate means for providing an increasing signal at an output thereof, and threshold means enabled when said increasing signal reaches a given amplitude to provide said control signal.

11. A system as set forth in claim 9 wherein said first switching means is operable when enabled to enable said spark generating means to provide sparks at spark electrodes which are positioned in the proximity of said pilot outlet for igniting fuel supplied to said pilot outlet, said second switching means being operable when enabled to disable said spark generating means.

12. A system as set forth in claim 11 wherein said second flame sensing means includes further switching means enabled in response to a flame impinging on said spark electrodes to provide a further control signal for maintaining said first switching means enabled.

13. A system as set forth in claim 9 wherein said control means includes a timer device energized whenever said first switching means is enabled, said timer device being operable to open contacts connected in an energizing path for said pilot valve to effect deenergization of said pilot valve at the end of a predetermined time interval after said timer device is energized, and said second switching means being operable when enabled to prevent said timer device from operating.

14. A system as set forth in claim 9 wherein said second switching means has first normally closed contacts connected in said enabling path for said control means, and second normally open contacts connected in an energizing path for said main valve, said second switching means being operable when enabled to open said first contacts to interrupt said enabling path for said control means, and to close said second contacts to complete said energizing path for said main valve.

15. A system as set forth in claim 14 wherein said first switching means has third normally open contacts connected in an energizing path for said pilot valve, and fourth normally open contacts connected in an energizing path for said main valve, said first switching means being operable when enabled to close said third contacts to complete said energizing path for said pilot valve and to close said fourth contacts to prepare said energizing path for said main valve, which is completed by said second contacts when said second contacts when said second switching means operates.

16. A system as set forth in claim 15 wherein said second switching means has further normally open contacts connected in an energizing path for said first switching means, said second switching means being operable when enabled to open said further contacts, and said first switching means including means for providing a holding path for said first switching means whenever said second switching means operates to open said further contacts.

17. In a fuel ignition system including a pilot valve operable when energized to supply fuel to a burner for ignition to provide a pilot flame, and a main valve operable when energized to supply fuel to said burner for ignition by the pilot flame, a control arrangement comprising first switching means for controlling the operation of the pilot valve, second switching means for controlling the operation of said main valve, control means operable at the start of an ignition cycle to enable said first switching means to energize said pilot valve, timing means enabled by said control means to permit said pilot valve to remain energized for a predetermined interval of time and to cause said pilot valve to be deenergized at the end of said time interval, first flame sensing means operable when a flame is provided at said burner during said time interval to enable said second switching means to energize said main valve and to disable said control means, said timing means being prevented from deenergizing said pilot valve when said second switching means is enabled, and second flame sensing means operable when a flame is provided at said burner during said time interval to maintain said first switching means enabled after said control means is disabled.

* * * * *